US011149450B2

(12) United States Patent
White

(10) Patent No.: US 11,149,450 B2
(45) Date of Patent: Oct. 19, 2021

(54) FORMWORK BASE

(71) Applicant: FAST-FORM SYSTEMS LTD, Grimsby (GB)

(72) Inventor: Tony White, Cleethorpes (GB)

(73) Assignee: Fast-Form Systems Ltd, Grimsby (GB)

( * ) Notice: Subject to any disclaimer, the term of this patent is extended or adjusted under 35 U.S.C. 154(b) by 0 days.

(21) Appl. No.: 15/956,419

(22) Filed: Apr. 18, 2018

(65) Prior Publication Data

US 2018/0298625 A1 Oct. 18, 2018

(30) Foreign Application Priority Data

Apr. 18, 2017 (GB) ..... 1706106

(51) Int. Cl.

| | |
|---|---|
| ***E04G 17/14*** | (2006.01) |
| ***E04G 17/00*** | (2006.01) |
| ***E04G 5/06*** | (2006.01) |
| ***E04G 13/00*** | (2006.01) |

(52) U.S. Cl.

CPC ..... *E04G 17/14* (2013.01); *E04G 5/062* (2013.01); *E04G 13/00* (2013.01); *E04G 17/002* (2013.01); *E04G 2005/068* (2013.01)

(58) Field of Classification Search

CPC . E04G 17/14; E04G 17/002; E04G 2005/068; E04G 5/062

USPC ..... 52/127.2; 404/51, 56, 61, 62, 63, 68, 71, 404/106; 14/77.1

See application file for complete search history.

(56) References Cited

U.S. PATENT DOCUMENTS

| | | | | | |
|---|---|---|---|---|---|
| 1,470,673 | A | * | 10/1923 | Ambursen | E04G 11/46 248/357 |
| 1,774,838 | A | * | 9/1930 | Mostowy | E04G 5/06 248/240.3 |
| 1,939,007 | A | | 12/1933 | Heltzel | |
| 2,313,880 | A | * | 3/1943 | Leggett, Sr. | E04G 11/14 248/354.4 |
| 2,315,956 | A | * | 4/1943 | Heath | E04B 5/21 52/324 |
| 2,482,367 | A | | 9/1949 | Ravers | |
| 2,661,516 | A | | 12/1953 | Yates | |

(Continued)

FOREIGN PATENT DOCUMENTS

| | | | |
|---|---|---|---|
| CA | 1329492 | C | 5/1994 |
| CA | 2957857 | A1 | 3/2015 |

(Continued)

OTHER PUBLICATIONS

USPTO translation of foreign document "CAMBON FR 2527711 A1" Published Aug. 22, 1986, USPTO translation 2019 "15956419_FR-2527711-A1.TRANS.pdf" (Year: 2019).*

*Primary Examiner* — Patrick J Maestri
*Assistant Examiner* — Joseph J. Sadlon
(74) *Attorney, Agent, or Firm* — RatnerPrestia

(57) ABSTRACT

Disclosed herein is a support base for use in shuttering formwork. The support base includes an angle section member and a plurality of clamping brackets. The clamping brackets further include clamping members engageable with the clamping brackets to define a clamping portion aligned with openings on the angle section member. Also disclosed herein is a method of supporting shuttering formwork which uses the support base.

15 Claims, 1 Drawing Sheet

(56) References Cited

U.S. PATENT DOCUMENTS 2,663,925 A * 12/1953 Yates ..... E04G 13/00 249/6
2,741,821 A 4/1956 Findley
2,772,468 A * 12/1956 Heltzel ..... E04G 13/00 249/3
2,846,748 A 8/1958 Owen et al.
2,846,749 A * 8/1958 Yates ..... E01C 19/502 249/7
3,016,225 A * 1/1962 Hughes ..... E04G 13/00 248/229.11
3,035,321 A * 5/1962 Hennig ..... E04G 11/12 249/27
3,136,023 A * 6/1964 Von Drasek ..... E01C 19/506 249/192
3,266,209 A * 8/1966 Scott Zibell Jules ..... E04B 2/76 52/665
3,428,287 A 2/1969 Redding et al.
3,595,510 A * 7/1971 Hutchinson ..... E04G 5/062 248/175
3,598,402 A * 8/1971 Frenzl ..... A63B 69/187 482/71
3,817,006 A * 6/1974 Williams ..... E04G 21/26 248/354.3
3,854,693 A * 12/1974 Kistler ..... E04C 3/08 249/210
3,908,793 A * 9/1975 Vaughn ..... E04G 5/046 182/82
3,950,857 A * 4/1976 Zanavich ..... B25H 7/00 33/528
4,034,957 A * 7/1977 Cody ..... E04C 3/06 249/189
4,068,427 A * 1/1978 Camardo ..... E04G 21/26 52/127.2
4,075,913 A * 2/1978 Tye ..... B25B 13/481 294/210
4,153,229 A * 5/1979 Bequette ..... E04G 5/062 248/240.3
4,159,604 A * 7/1979 Burrell ..... E04C 3/292 52/376
4,181,995 A * 1/1980 Zur ..... E01D 15/133 104/126
4,254,932 A * 3/1981 Durbin ..... E04G 11/12 249/18
4,350,318 A * 9/1982 Gallis ..... E04G 17/042 249/219.2
4,381,160 A * 4/1983 Grimm ..... E04H 12/2261 248/357
4,540,309 A * 9/1985 Hansson ..... E04B 1/4107 403/230
4,624,342 A * 11/1986 Anderson ..... E04G 1/20 182/223
4,644,709 A * 2/1987 Baumann ..... E04B 1/34823 52/127.2
4,659,054 A * 4/1987 Allen ..... E01C 19/2035 249/207
4,712,764 A 12/1987 White
4,921,204 A 5/1990 Melfi
4,996,770 A * 3/1991 McCracken ..... E04G 17/14 248/357
5,076,536 A 12/1991 Fitzgerald
5,096,155 A * 3/1992 Fitzgerald ..... E01C 19/502 249/219.1
5,131,164 A * 7/1992 Miller ..... E04F 21/18 33/427
5,228,262 A * 7/1993 Meriwether ..... E04G 21/26 52/127.2
5,233,807 A * 8/1993 Spera ..... E04G 11/12 52/837
5,253,839 A * 10/1993 McClure ..... E04G 15/02 248/354.1
5,261,635 A 11/1993 Flathau
5,692,357 A * 12/1997 McCain ..... B25B 11/02 33/194
5,817,247 A 10/1998 Colatruglio
5,843,327 A * 12/1998 Lindgren ..... E04G 11/087 249/210
6,003,630 A * 12/1999 Whalen ..... E04G 3/20 182/82
6,021,994 A * 2/2000 Shartzer, Jr. ..... E01C 19/502 249/189
6,059,487 A * 5/2000 Haga ..... E01F 15/0476 256/13.1
6,158,710 A * 12/2000 Matthews ..... E02D 27/02 249/18
6,421,863 B1 * 7/2002 Tiffany ..... E01D 19/005 14/2.4
6,439,344 B1 * 8/2002 Cole ..... A62B 35/0068 182/113
6,513,286 B2 * 2/2003 Vierra ..... E04D 13/158 248/215
6,568,651 B2 * 5/2003 Reid ..... E04G 13/00 249/191
6,622,453 B2 * 9/2003 Dove ..... B25G 3/18 15/105
6,629,681 B1 * 10/2003 Miller ..... E01C 19/502 249/13
6,863,270 B2 * 3/2005 Bartley, Jr. ..... A47B 51/00 269/37
7,000,358 B2 * 2/2006 Clapp ..... E02D 27/02 52/294
7,229,062 B1 * 6/2007 Rascon ..... E04G 13/00 249/218
7,406,776 B2 * 8/2008 Brumbaugh ..... G01D 5/34746 33/613
8,028,476 B1 10/2011 Alford
8,210,492 B2 * 7/2012 Serrano Rodriguez ... E04G 9/06 249/192
8,261,509 B2 * 9/2012 Harkin ..... E04G 23/0237 52/645
8,539,691 B2 * 9/2013 Daniel ..... A47G 1/205 33/613
8,915,027 B1 * 12/2014 Alfieri, III ..... A01G 9/28 52/102
8,919,726 B2 * 12/2014 Hendricks ..... E04G 11/062 249/192
9,540,830 B2 * 1/2017 Rosati ..... E04G 17/001
9,556,630 B2 * 1/2017 Rosati ..... E04G 21/3247
9,833,689 B2 * 12/2017 Smith ..... A63C 19/08
10,450,764 B2 * 10/2019 Woodford ..... E04G 23/04
2003/0146363 A1 8/2003 Miller et al.
2006/0201743 A1 9/2006 Dell'Erba et al.
2006/0260263 A1 * 11/2006 Cannata ..... E04G 17/14 52/846
2008/0265128 A1 * 10/2008 Hughes ..... E04G 13/00 249/190
2016/0194887 A1 7/2016 White
2017/0114539 A1 * 4/2017 Dixon ..... E04C 2/044
2017/0292280 A1 10/2017 White
2018/0298625 A1 10/2018 White

FOREIGN PATENT DOCUMENTS

CN 202064630 U 12/2011
DE 2142150 A1 3/1972
DE 4000400 A1 7/1991
DE 202006019268 U1 5/2007
EP 3042009 A1 7/2016
FR 1266919 A * 7/1961 ..... E04G 11/12
FR 2527711 A1 * 12/1983 ..... E04G 7/307
FR 2542789 A1 9/1984
FR 2835554 A1 8/2003
FR 2884536 A1 10/2006
GB 696260 8/1953
GB 762382 11/1956
GB 770446 3/1957
GB 807681 1/1959
GB 2508263 A 5/2014
GB 2533172 A 6/2016

(56) References Cited

FOREIGN PATENT DOCUMENTS

| | | | |
|---|---|---|---|
| GB | 2539371 | A | 12/2016 |
| GB | 2556866 | A | 6/2018 |
| GB | 2561567 | A | 10/2018 |
| GR | 1004120 | B | 1/2003 |
| JP | 01105867 | A | 4/1989 |
| JP | 07300856 | A | 11/1995 |
| JP | 1061181 | A | 3/1998 |
| WO | 9203626 | A1 | 3/1992 |
| WO | 9214015 | A1 | 8/1992 |
| WO | 9420694 | A1 | 9/1994 |
| WO | 2007024883 | A2 | 3/2007 |
| WO | 2013016760 | A1 | 2/2013 |
| WO | 2015033109 | A1 | 3/2015 |
| WO | 2016110663 | A1 | 7/2016 |
| WO | 2018055323 | A1 | 3/2018 |

* cited by examiner

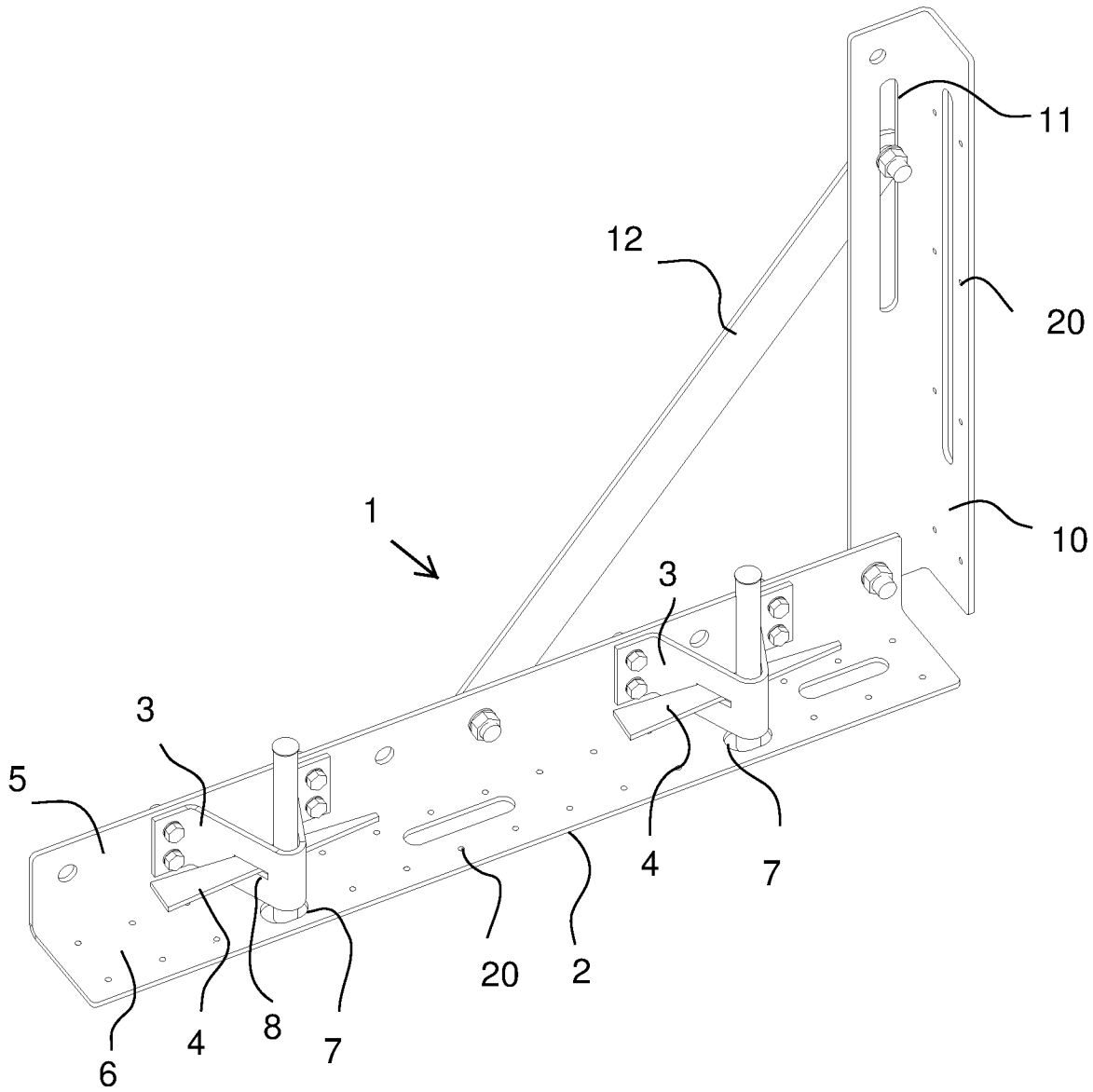
11
20
10
12
3
7
4
2
20
1
7
8
4
3
6
5

FORMWORK BASE

CROSS REFERENCE TO RELATED APPLICATIONS

This application claims priority to Great Britain application GB1706106.0 filed Apr. 18, 2017, the contents of such application being incorporated by reference herein.

FIELD OF THE INVENTION

The present invention relates to a support base, particularly a support base for use in or with shuttering formwork. The present invention also relates to a method of supporting shuttering formwork using the support base of the invention.

BACKGROUND TO THE INVENTION

Concrete walls, pillars or columns are conventionally formed using formwork which is applied around the edge of the structure to be formed. The formwork supports shuttering contact board which provides a surface against which the concrete can be poured. When the concrete is poured, considerable force is applied to the board and consequently to the formwork due to the weight of the concrete. This can cause the formwork to move, and consequently the resultant structure is formed incorrectly.

Thus with any formwork it is necessary to anchor the formwork appropriately to the ground or other static structure so that the formwork does not move when the concrete is poured.

The present solutions offered include brackets which are pined to the ground using road pins or some form of bolts or similar fixings. Unfortunately such solutions are not satisfactory as their interaction with the brackets is such that they fail to prevent the brackets from lifting when the concrete is applied.

There has now been devised a support base which overcomes and/or substantially mitigates the above referenced and/or other disadvantages associated with the prior art.

SUMMARY OF THE INVENTION

In one aspect of the invention there is provided a support base for use in shuttering formwork, the support base comprising,

- an angle section member having on a first side a plurality of openings, each opening being suitable for receiving a roadway pin or the like, and
- a plurality of clamping brackets coupled to the adjacent second side of the angle section member and aligned over the openings,
- the clamping brackets further comprising clamping members engageable with the clamping brackets to define a clamping portion aligned with the openings.

The support base according to the invention is advantageous primarily because a clamping portion is defined which can clamp onto any road pins or the like inserted into the clamping portion. This prevents the support base from moving with respect to the pins. In use when the support base is used with shuttering formwork and concrete is poured against the formwork, the support base is prevented from lifting or moving at all.

The angle section member may be a length of channel section or right angle section. Preferably the support base is manufactured from metal, such as steel or aluminium, but other materials such as plastics or composite materials are also possible.

The openings in the first side are preferably spaced apart from one another substantially along the length of the angle section member. This allows roadway pins or the like to be inserted through the angle section member in positions which are separated from one another substantially.

Roadway pins is a term used in the art to describe pins inserted into formwork to support said formwork against a roadway. The term therefore includes any suitable means for fixing into roadways or the ground. Suitable roadway pins or the like includes stakes, screws, bolts, or plugs. Typically a roadway pin is a round pin made of steel with a pointed or sharpened end for penetrating the ground and a flat end that is hit with a hammer or similar in order to drive the pin into the ground. The roadway pin can also be made from plastics, composites or other metals.

It will be appreciated that the support base is suitable for use with many types of formwork. As such, the angle section member may have a number of holes or slots in it in order to attach parts of formwork to the angle section member. Preferably, a shuttering contact member is coupled to the second side and at one end of the angle section member. Preferably a bracing member is coupled at one end to the second side at a position between the two ends of the angle section member, and at the opposite end to the shuttering contact member. The bracing member and/or the shuttering contact member may be adjustable in length. For example therefore, the bracing member may comprise a screw jack, or a telescoping element or the like. The bracing member and the shuttering contact member are hingedly engaged to each other at the respective ends of the bracing member and the shuttering contact member that are opposite the ends connected to the angle section member. Thus a triangular shaped formwork may be constructed using the support base of the present invention as the base. The angle section member and/or the shuttering contact member may contain slots. The brace may be slidably engaged with said slots.

The clamping brackets may be any type of bracket that maximises the clamping portion onto the roadway pin or the like in use. Preferably the clamping brackets are substantially "V" shaped. This is a simple bracket form and increases the strength of the second side of the angle section member. The effect is therefore to reduce the potential for the angle section member to buckle in use. The coupling of the brackets to the angle section member may be by conventional nut and bolt fixing, screws, or welding. The central part of the 'V' provides an opening for receipt of the roadway pin or the like in use.

When a 'V' shaped clamping bracket is used, preferably the clamping brackets comprise a first opening and a second opening, the first and second opening being opposite one another and on different sides of the 'V' shaped bracket.

Preferably, the first opening is larger than the second opening, and the clamping member comprises a wedge which is engageable through the first and second openings, and matches the dimensions of the first and second openings substantially. This has the benefit that when the wedge is inserted into the clamping bracket therethrough, a clamping portion is defined between the wedge and the inside of the apex of the 'V'. This provides a quick and efficient way to mount the support base at the side of the planned formwork or concrete wall/pillar/column etc. As the bracket is 'V' shaped, it maximises the area of the pin or the like that is clamped in the clamping portion. This form of bracket in combination with the wedge maximises the frictional forces that are generated if the support base is attempted to be lifted by the weight of the concrete in use. These forces are thereby much greater than the lifting forces and the support bases do not lift out of the ground.

Alternatively, the first opening is of similar dimensions to the second opening and the clamping member comprises a bar having a central cam. When the bar is inserted through the first and second openings, a clamping portion between the bar and the bracket is defined substantially as described above. A roadway pin or the like is inserted through the clamping portion and when the bar is rotated the cam tightens on the roadway pin or the like and clamps the angle section member to the pin.

In another aspect of the invention there is provided a method of supporting shuttering formwork, the method comprising assembling a support base substantially as described above, coupling a shuttering contact member to the second side and at one end of the angle section member;

coupling one end of a bracing member to the second side at a position between the two ends of the angle section member, and at the opposite end to the shuttering contact member;

engaging clamping members with the clamping brackets to define the clamping portion; and inserting road pins into the clamping portion and through the openings.

The method as described above may further comprise the step of applying a retainer to the clamping members after they have been engaged with the clamping brackets. This prevents the clamping members from being lost. The retainer may be a bolt or clamp or the like, but preferably comprises a weld applied to one side of the clamping member. Alternatively a simple twist to the clamping member is applied so that it cannot detach easily from the brace.

The invention will now be described by way of example only with reference to and as shown in the drawings in which:

BRIEF DESCRIPTION OF THE DRAWINGS

The FIGURE shows a perspective view of an embodiment of the support base according to the invention.

DETAILED DESCRIPTION OF THE ILLUSTRATED EMBODIMENT

In the FIGURE there is shown an example of the support base generally designated 1. The support base 1 comprises an angle section member 2, two 'V' shaped clamping brackets 3 and clamping members 4. The brackets 3 are bolted to the second side 5 of the angle section member 2. In the first side 6 of the angle section member 2 there are two openings 7. The brackets 3 are arranged such that the apex of each 'V' lies over a respective opening 7, as shown. The clamping members 4 are wedges of steel which engage through slots 8 in the sides of the brackets 3. At one end of the angle section member 2 there is pivotally attached a shuttering contact member 10. The shuttering contact member 10 comprises another angle section piece of steel having a slot 11 to slidably receive a brace 12. One end of the brace is engaged with the slot 11 using conventional nut and bolt fixings, and the opposite end of the brace 12 is connected to the second side 5 of the angle section member 2. Conventional nut and bolt fixings are used to connect the brace 12 to the angle section member 2. The slot 11 allows the angle of the shuttering contact member with respect to the support base 2 to be adjusted and then fixed rigidly. This makes erection of the formwork simply, quick and easy, while also allowing for the construction of walls which are not necessarily vertical. Although not shown on the drawings, on each bracket 3, there are two slots 8 opposite one another. The slots 8 on the brackets 3 are of different sizes and match the external dimensions of the centre region of the wedges 4. Therefore when the wedges 4 are inserted, they can only be inserted and engaged to fit from one direction only, and when they are inserted an equal amount of the wedge protrudes out of one side of the bracket 3 as on the other side of the bracket 3. In the example shown the slots 8 are wider towards the end of the angle section member opposite that which is attached to the shuttering contact member 10. This makes it easier to insert the wedges 4 through the slots. If the width of the slots 8 on the brackets 3 were orientated the other way round, then the wedges 4 could only be inserted in the opposite direction to that shown in the FIGURE. It is likely therefore that the shuttering contact member would interfere with this procedure, and prevent the wedges from actually being fully inserted. The angle section member 2 and shuttering contact member 10 comprises a number of further holes 20 which are provided for the attachment of boarding or the like.

In use the clamping brackets 3 are attached to the second side 5 using the bolts as shown, making sure that the brackets are positioned over the openings 7. Next the shuttering contact member 10 is attached using a bolt fixing to the end of the angle section member 2 on the second side 5. Care is taken to ensure that some distance is provided between the end of the shuttering contact member 10 and the first side 6, in order to allow for angular alteration of the shuttering contact member with the base if required. Next the brace 12 is attached to the angle section member 2 and the shuttering contact member 10 as shown and as described above. Also in this step the wedges 4 are inserted through the openings 8 of the brackets 3. In so doing a clamping portion is defined between the wedges and the inside of the brackets 3. Next, road pins are inserted through the clamping portion and through the openings 7 and into the ground on which the support base 1 is placed. A spot weld may be placed on the narrow end of the wedges 4 to prevent them from being lost. Shuttering board may be attached to the shuttering contact board after the angle of the shuttering contact member has been set. Then concrete can be poured against it. The support base 1 is prevented from moving or lifting up in any way by the combined effect of the brackets 3 and the wedges 4 to generate a clamping portion which clamps onto the pins. The support base 1 therefore does not move in use with respect to the pins.

The invention claimed is:

1. A support base for use in shuttering formwork, the support base configured to be disposed on a ground, the support base comprising:

a right angle section member having a first side and an adjacent second side that define a right angle, the first side having a first surface arranged to be in contact with the ground and a second surface opposite the first surface, the first side having a plurality of openings, the right angle second member having opposite first and second ends;

a shuttering contact member, configured for contacting the shuttering formwork and pivotally coupled to the second end of the second side of the right angle section member, the shuttering contact member extending vertically from the second member and having an adjustable and rigidly fixable angle relative to the right angle section member as defined by a at least one bracing member having one end adjustably coupled to the second side of the right angle section member with a first fixing member and an opposite end adjustably coupled to the shuttering contact member with a second fixing member, wherein at least one of the right angle section or the shuttering contact member comprises a slot having a length for receiving one of the first or second fixing members in a slidably adjustable engagement fixable at any point along an entire length of the slot;

a plurality of roadway pins, each roadway pin configured to be inserted through one of the plurality of openings with a portion of the roadway pin extending vertically above a second surface of the first side of the right angle section member;

a plurality of clamping brackets directly coupled to the second side of the right angle section member, including a first clamping bracket and a second clamping bracket, each clamping bracket further comprising a clamping member engageable with each clamping bracket to define a clamping portion aligned over one of the plurality of openings and positioned to engage one of the plurality of roadway pins disposed therein in the portion of the roadway pin extending above the second surface of the first side of the right angle section member;

wherein the first clamping bracket is positioned relatively closer to the first end of the right angle section member than the second clamping bracket, and the at least one bracing member is coupled to the right angle section member at a position between the first clamping bracket and the second clamping bracket.

2. The support base according claim 1, wherein the clamping brackets are V-shaped in plan view from above the first side of the right angle section member, with opposite arms of the "V" fastened to the second side of the right angle section member and an apex of the "V" positioned to receive the one of the plurality of roadway pins.

3. The support base according to claim 2, wherein each of the clamping brackets comprises a first opening and a second opening opposite one another on different arms of the "V" and the clamping member has a wedge shape engageable through the first and second openings to capture the one of the plurality of roadway pins between the clamping member and the apex of the "V".

4. The support base according to claim 3, wherein the first opening is larger than the second opening, and the wedge shape of the clamping member has a tapered center region with exterior dimensions that match the dimensions of the first and second openings.

5. The support base of claim 4, comprising the shuttering contact member coupled to the second side and at one end of the right angle section member, wherein the smaller opening of each bracket is closer to the shuttering contact member than the larger opening.

6. A method of supporting shuttering formwork, the method comprising:

assembling the support base according to claim 1 by:

coupling the shuttering contact member to the second side and at one end of the right angle section member;

coupling one end of a bracing member to the second side at a position between the two ends of the right angle section member, and at the opposite end to the shuttering contact member;

engaging clamping members with the clamping brackets to define the clamping portions; and inserting the plurality of roadway pins into the clamping portions and through the openings.

7. The method according to claim 6, wherein the bracing member is pivotally engageable with the right angle member, the method comprising adjusting and rigidly fixing the angle between the shuttering contact member and right angle section member by fixing the second fixing member to the shuttering contact member at a selected location along the length of the second slot.

8. The method according to claim 7, wherein a retainer is applied to the clamping members after they have been engaged with the clamping brackets.

9. The method according to claim 8, wherein the retainer comprises a weld applied to one side of the clamping member.

10. The method according to claim 6, wherein a retainer is applied to the clamping members after they have been engaged with the clamping brackets.

11. The method according to claim 10, wherein the retainer comprises a weld applied to one side of the clamping member.

12. The support base of claim 1, wherein the bracing member is pivotally coupled to the second side of the right angle section member.

13. The support base of claim 12, wherein the first fixing member comprises a first bolt configured for fixation with a first nut and the second fixing member comprises a second bolt configured for fixation with a second nut.

14. The support base of claim 12, wherein the shuttering contact member has a cross section consisting of a right angle defined by a shuttering contact member first side and an adjacent shuttering contact member second side, wherein the shuttering contact member first side contains the slot for receiving the second fixing member for pivotally coupling the bracing member to the shuttering contact member.

15. The support base of claim 14, wherein the shuttering contact member is pivotally coupled to the second end of the second side of the right angle section member on the first side of the shuttering contact member.

* * * * *